US007066832B2

(12) United States Patent
Willett et al.

(10) Patent No.: US 7,066,832 B2
(45) **Date of Patent: *Jun. 27, 2006**

(54) GOLF CLUB HEAD

(75) Inventors: Kraig A. Willett, Fallbrook, CA (US); Joseph H. Hoffman, Carlsbad, CA (US); Michael Scott Burnett, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/928,511

(22) Filed: Aug. 27, 2004

(65) Prior Publication Data

US 2005/0026720 A1 Feb. 3, 2005

Related U.S. Application Data

(63) Continuation of application No. 10/302,331, filed on Nov. 22, 2002, now Pat. No. 6,800,038, which is a continuation-in-part of application No. 09/898,843, filed on Jul. 3, 2001, now Pat. No. 6,824,475.

(51) Int. Cl.
*A63B 53/04* (2006.01)

(52) U.S. Cl. ..... 473/329; 473/342; 473/345; 473/346; 473/349

(58) Field of Classification Search ..... 473/324–350, 473/291; D21/733–753
See application file for complete search history.

(56) References Cited

U.S. PATENT DOCUMENTS

| | | | |
|---|---|---|---|
| 4,432,549 | A | 2/1984 | Zebelean |
| 5,024,437 | A | 6/1991 | Anderson |
| 5,425,538 | A | 6/1995 | Vincent et al. |
| 5,643,108 | A | 7/1997 | Cheng |

(Continued)

FOREIGN PATENT DOCUMENTS

| | | |
|---|---|---|
| GB | 2332149 A | 6/1999 |
| JP | 2002-065907 | 3/2002 |

(Continued)

*Primary Examiner*—Sebastiano Passaniti
(74) *Attorney, Agent, or Firm*—Sheppard, Mullin, Richter & Hampton LLP

(57) ABSTRACT

A golf club head is provided having a substantially increased sweet spot. A preferred embodiment includes a striking plate, the striking plate having a striking surface, a rear surface opposed to the striking surface and defining a thickness therebetween, and a periphery. The periphery has a first edge, a second edge, a third edge, and a fourth edge. A balance point is disposed in a central region of the striking surface, a first thickness profile extending between the balance point and the first edge, a second thickness profile extending between the balance point and the second edge, a third thickness profile extending between the balance point and the third edge, and a fourth thickness profile extending between the balance point and the fourth edge. Each of the first, second, third, and fourth thickness profiles includes a first region encompassing the periphery of the striking plate, a second region disposed between the first region and the balance point, and a third region disposed between the second region and the balance point. Each of the third and fourth thickness profiles has a maximum second region thickness at least 1.5 times greater than a minimum first region thickness. Each of the first and second thickness profiles has a second region thickness that is less than the maximum second region thickness of the third and fourth thickness profiles and greater than or equal to the minimum first region thickness. Each of the first, second, third, and fourth thickness profiles has a third region thickness that is less than the maximum second region thickness of the third and fourth thickness profiles and greater than the minimum first region thickness.

20 Claims, 9 Drawing Sheets

U.S. PATENT DOCUMENTS 5,830,084 A 11/1998 Kosmatka
5,911,637 A 6/1999 Yamagata
5,971,868 A 10/1999 Kosmatka
6,007,432 A 12/1999 Kosmatka
6,319,150 B1 11/2001 Werner et al.
6,652,391 B1 11/2003 Kubica et al.
2001/0051548 A1 12/2001 Iwata et al.
2002/0189356 A1 12/2002 Bissonnette et al.

FIG. 12
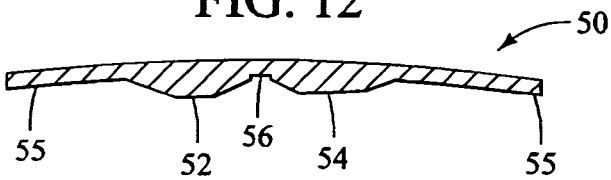
FIG. 11
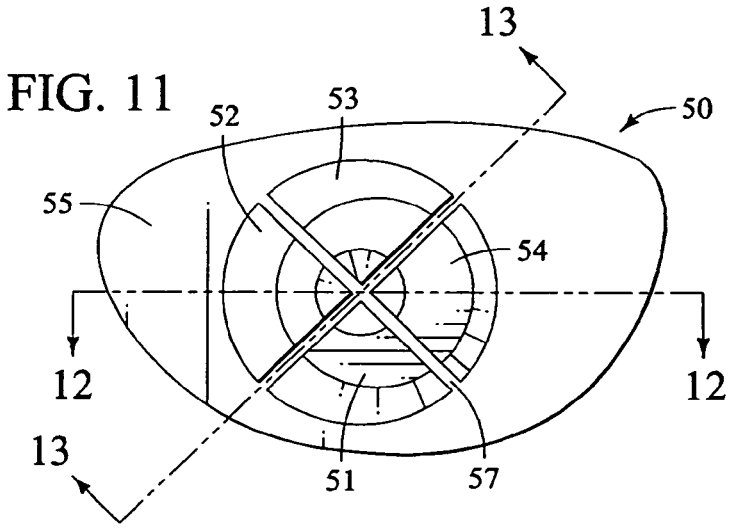
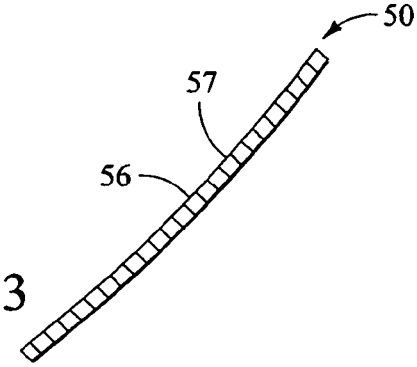
FIG. 13

GOLF CLUB HEAD

CROSS REFERENCE TO RELATED APPLICATIONS

This application is a continuation of Ser. No. 10/302,331, filed Nov. 22, 2002, now U.S. Pat. No 6,800,038, which is a continuation-in-part of Ser. No. 09/898,843, filed Jul. 3, 2001 now U.S. Pat. No. 6,824,475.

BACKGROUND OF THE INVENTION

The present invention relates generally to golf club heads and, more particularly, to golf club heads having an improved face construction.

Modem golf clubs have typically been classified as woods, irons or putters. Additionally, a newer class of golf clubs termed "utility" clubs or "iron woods" seek to replace low lofted long irons or higher numbered fairway woods. The term "wood" is a historical term that is still commonly used, even for golf clubs that are constructed of steel, titanium, fiberglass and other more exotic materials, to name a few. The woods are now often referred to as "metal woods." The term "iron" is also an historical term that is still commonly used, even though those clubs are not typically constructed of iron, but are rather constructed of many of the same materials used to construct "woods".

One particular improvement that relates especially to metal woods is the use of lighter and stronger metals, such as titanium. A significant number of the premium metal woods, especially drivers, are now constructed primarily using titanium. The use of titanium and other lightweight, strong metals has made it possible to create metal woods of ever increasing sizes. The size of metal woods, especially drivers, is often referred to in terms of volume. For instance, current drivers may have a volume of 300 cubic centimeters (cc) or more. Oversized metal woods generally provide a larger sweet spot and a higher inertia, which provides greater forgiveness than a golf club having a conventional head size.

One advantage derived from the use of lighter and stronger metals is the ability to make thinner walls, including the striking face and all other walls of the metal wood club. This allows designers more leeway in the positioning of weights. For instance, to promote forgiveness, designers may move the weight to the periphery of the metal wood head and backwards from the face. As mentioned above, such weighting generally results in a higher inertia, which results in less twisting due to off-center hits.

There are limitations on how large a golf club head can be manufactured, which is a function of several parameters, including the material, the weight of the club head, the strength of the club head, and the materials used. Additionally, to avoid increasing weight, as the head becomes larger, the thickness of the walls must be made thinner, including that of the striking face. As a result, as the striking face becomes thinner, it has a tendency to deflect more and more at impact, and thereby has the potential to impart more energy to the ball. This phenomenon is generally referred to as the "trampoline effect." A properly constructed club having a thin face can therefore impart a higher initial velocity to a golf ball than can a club having a rigid thick face. Because initial velocity is an important factor in determining how far a golf ball travels, this is very important to golfers.

It is appreciated by those skilled in the art that the initial velocity imparted to a golf ball by a thin-faced metal wood varies depending on the location of the point of impact of a golf ball on the striking face. Generally, balls struck in the sweet spot will have a higher rebound velocity. Many factors contribute to the location of the sweet spot, including the location of the center of gravity (CG) and the shape and thickness of the striking face.

Prior golf club heads have provided an increased initial or launch velocity of a golf ball, by incorporating a lightweight, flexible face. Manufacturers of metal wood golf club heads have more recently attempted to manipulate the performance of their club heads by designing what is generically termed a variable face thickness profile for the striking face, in particular with the use of lightweight materials such as titanium alloys.

Another approach to reduce stress at impact is to use one or more ribs extending substantially from the crown to the sole vertically across the face, and in some instances also extending from the toe to the heel horizontally across the face. Because the largest stresses are located at the impact point, usually at or substantially near the sweet spot, the center of the face is also thickened and is at least as thick as the ribbed portions.

There have been other configurations and ribs formed on the back of a club face, including one or more thin rings, a power bar, and a cone formation. Multiple thin rings have been attached by various means so as to add mass directly behind the sweet spot, and alternatively a spiral formation has been used, wherein the multiple rings or spiral mass extend from the sweet spot substantially toward the periphery of the face plate. A single thin ring at the sweet spot has been used on an iron club head in conjunction with an added toe mass in order to reposition a point of least rigidity to the center of the face. In this configuration the rigidity of the face is always higher radially outward from the centered ring.

Other club heads have attempted to utilize power bars or cones behind the sweet spot in order to increase the force imparted to a golf ball. These power bars and cones involve significant additional mass extending toward a rear of the club head, thus affecting the club head's center of gravity. However, such club heads do not provide a coefficient of restitution (COR) that is at least the minimum value of approximately 0.8 that is sought by today's golfers.

The COR for a golf club may be informally defined as a function of the ratio of the relative velocities of a golf ball, just prior to and immediately after impact with the golf club head. The COR baseline value of e=0.822 has been established in the United States, and the formal equation also accounts for the relative masses of a specific club head as well as a golf ball, as follows:

$$V_{out}/V_{in}=(eM-m)/(M+m)$$

(where M is the mass of the club head and m is an average mass of the golf ball population. $V_{out}$ is the ball rebound velocity and $V_{in}$ is the incoming velocity of the ball that is shot at the face of the golf club head using an air cannon, for example.)

In each of the foregoing examples, however, there is ultimately a failure to provide significant forgiveness to off-center hits. Each golf club has attempted to increase COR while addressing to various degrees the difficulties in doing so. For these clubs, the point of impact must still be at the sweet spot in order for these clubs to deliver their highest COR, and even the slightest deviation of the impact from the sweet spot will result in a significant loss in ball velocity.

SUMMARY OF THE INVENTION

The present invention provides a solution to enable club designers to overcome the problems described above, including a golf club head that exhibits greater forgiveness across a substantial portion of the striking face while continuing to impart high initial velocity to a golf ball.

In a preferred embodiment of the invention, a golf club head has a body having a toe portion, a heel portion, a sole portion, and a crown portion, together defining an opening. A is disposed in the opening and has a striking surface, a rear surface opposed to the striking surface and defining a thickness therebetween, and a periphery. This periphery has a first edge, a second edge, a third edge, and a fourth edge. A balance point is disposed in a central region of the striking surface.

A first thickness profile extends between the balance point and the first edge, a second thickness profile extends between the balance point and the second edge, a third thickness profile extends between the balance point and the third edge, and a fourth thickness profile between the balance point and the fourth edge. Each of the first, second, third, and fourth thickness profiles includes a first region encompassing the periphery of the striking plate, a second region disposed between the first region and the balance point, and a third region disposed between the second region and the balance point. Each of the third and fourth thickness profiles has a maximum second region thickness at least 1.5 times greater than a minimum first region thickness. Each of the first and second thickness profiles has a second region thickness that is less than the maximum second region thickness of the third and fourth thickness profiles and greater than or equal to the minimum first region thickness.

Alternatively, a golf club head of the present invention may comprise a body defining a toe portion, a heel portion, a sole portion, a crown portion, and a striking plate. The striking plate has a striking surface, a rear surface opposed to the striking surface and defining a thickness therebetween, and a periphery, wherein the periphery has a first edge, a second edge, a third edge, and a fourth edge. A balance point is disposed in a central region of the striking surface, a first thickness profile extending between the balance point and the first edge, a second thickness profile extending between the balance point and the second edge, a third thickness profile extending between the balance point and the third edge, and a fourth thickness profile extending between the balance point and the fourth edge. Each of the first, second, third, and fourth thickness profiles includes a first region encompassing the periphery of the striking plate, a second region disposed between the first region and the balance point, and a third region disposed between the second region and the balance point. Each of the first, second, thirds and fourth thickness profiles has a third region thickness that is greater than a first region thickness and less than a second region thickness.

In another embodiment of the present invention, a striking plate for a golf club head comprises a striking surface, a rear surface opposed to the striking surface and defining a thickness therebetween, and a periphery. The periphery has a first edge, a second edge, a third edge, and a fourth edge. A balance point is disposed in a central region of the striking surface.

A first stiffness profile extends between the balance point and the first edge, a second stiffness profile between the balance point and the second edge, a third stiffness profile between the balance point and the third edge and a fourth stiffness profile between the balance point and the fourth edge. Each of the first, second, third, and fourth stiffness profiles includes a first region encompassing the periphery of the striking plate, a second region disposed between the first region and the balance point, and a third region disposed between the second region and the balance point. Each of the third and fourth thickness profiles has a maximum second region thickness at least 1.5 times greater than a minimum first region thickness. Each of the first and second thickness profiles has a second region thickness that is less than the maximum second region thickness of the third and fourth thickness profiles and greater than or equal to the minimum first region thickness. Each of the first, second, third, and fourth thickness profiles has a third region thickness that is less than the maximum second region thickness of the third and fourth thickness profiles and greater than the minimum first region thickness.

In yet another embodiment of the invention, the striking plate has a first thickness profile between the balance point and the first edge, a second thickness profile between the balance point and the second edge, a third thickness profile between the balance point and the third edge, and a fourth thickness profile between the balance point and the fourth edge. Each of the first, second, third, and fourth thickness profiles includes a first region encompassing the periphery of the striking plate, a second region disposed between the first region and the balance point, and a third region disposed between the second region and the balance point. Each of the first, second, third, and fourth thickness profiles has a third region thickness that is greater than a first region thickness and less than a second region thickness.

In yet another embodiment of the invention, a striking plate striking plate for a golf club head comprising a striking surface, a rear surface opposed to the striking surface and defining a thickness therebetween, and a periphery. The periphery has a first edge, a second edge, a third edge and a fourth edge. A balance point is disposed in a central region of the striking plate. A first stiffness profile extends between the balance point and the first edge, a second stiffness profile extends between the balance point and the second edge, a third stiffness profile extends between the balance point and the third edge, and a fourth stiffness profile extends between the balance point and the fourth edge. Each of the first, second, third, and fourth stiffness profiles includes a first region encompassing the periphery of the striking plate, a second region disposed between the first region and the balance point, and a third region disposed between the second region and the balance point. Each of the third and fourth stiffness profiles has a maximum second region stiffness at least 3.5 times greater than a minimum first region stiffness. Each of the first and second stiffness profiles has a second region stiffness that is less than the maximum second region sniffiness of the third and fourth stiffness profiles and greater than or equal to the minimum first region stiffness. Each of the first, second, third, and fourth stiffness profiles has a third region stiffness that is less than the maximum second region stiffness of the third and fourth stiffness profiles and greater than the minimum first region. stiffness.

The present invention provides a solution to enable club designers to overcome the problems described above, including a golf club head that exhibits greater forgiveness across a substantial portion of the striking surface while continuing to impart high initial velocity to a golf ball.

Other features and advantages of the present invention should become apparent from the following description of the preferred embodiments, taken in conjunction with the accompanying drawings, which illustrate, by way of example, the principles of the invention.

BRIEF DESCRIPTION OF THE DRAWINGS

FIG. 11 is a rear elevational view of another embodiment of a face insert of the present invention that has discontinuous thicknesses and that is also asymmetric, at least as viewed along a line between the heel and toe ends of the insert.

FIG. 12 is a cross-sectional view of the face insert of FIG. 11, taken along lines 12—12 in FIG. 11.

FIG. 13 is a cross-sectional view of the face insert of FIG. 11, taken along lines 13—13 in FIG. 11.

FIG. 14A is cross-sectional view of FIG. 14, taken along lines A—A in FIG. 14.

FIG. 15A is a cross-sectional view of FIG. 15, taken along lines A—A in FIG. 15.

DETAILED DESCRIPTION OF THE PREFERRED EMBODIMENTS

Figure 1:
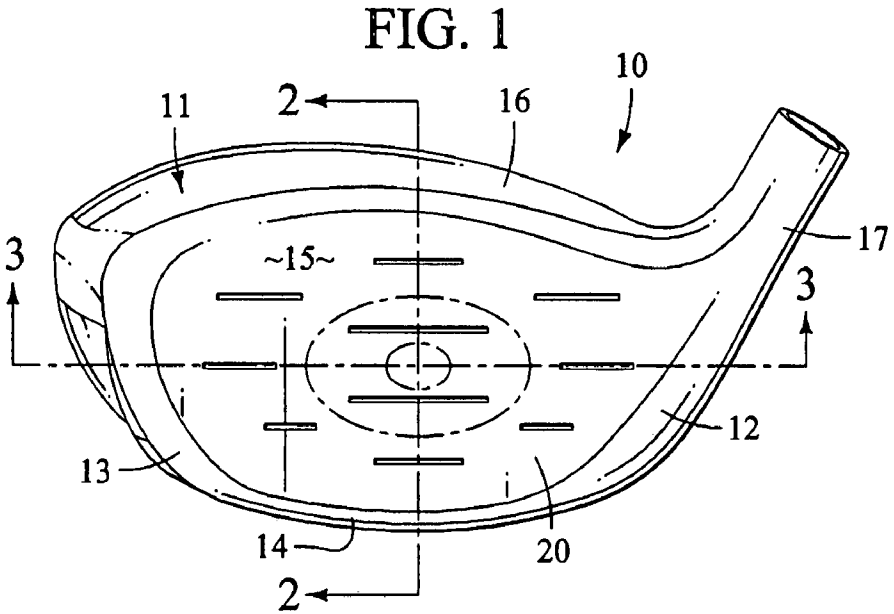
FIG. 1 shows a front view of a first embodiment of a golf club head of the present invention.

The drawings depict several preferred embodiments of a golf club head in accordance with the present invention. With reference to FIG. 1, a club head 10 is shown that is similar to many metal wood club heads that are known in the art. Club heads within the scope of the invention are not necessarily limited to the shape depicted. The club head comprises a hollow metallic body 11 and a striking or face plate 20. The body comprises a heel portion 12, a toe portion 13, a sole portion 14 and a crown portion 16 that cooperate to define an opening (not shown) that receives the striking plate. The striking plate is shown in greater detail in FIGS. 2–4. The club head is normally connected to a shaft (not shown) by a hosel 17 that is integrally formed with the body. Preferably, the body is constructed of stainless steel or a titanium alloy, but alternatively can be constructed of other materials such as a silicon steel alloy, various composites, and combinations thereof. The club head is preferably manufactured such that the body, including the heel portion, toe portion, sole portion, crown portion and hosel are integrally formed, and the striking plate having a striking face 15 is fixedly attached by means known in the art. However, the various portions of the preferred body may be separately molded, cast, forged or otherwise manufactured by means known in the art, and fixedly attached to form the body.

Figure 4:
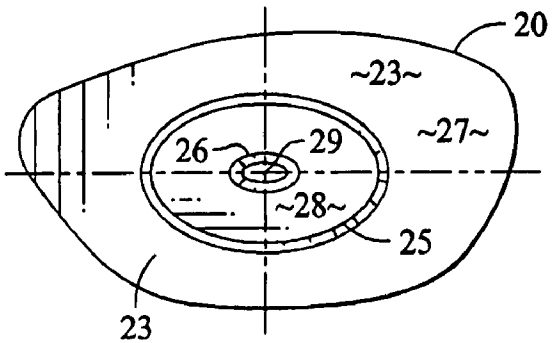
FIG. 4 is a rear elevational view of a face insert corresponding to the golf club head of FIG. 1.

FIG. 4 shows the rear surface 23 of the striking plate formed from stainless steel. The rear surface comprises an outer rear surface 27 and an inner rear surface 29. Between the outer rear surface and the inner rear surface is a raised surface 28. The raised surface forms an area that is substantially elliptical. Proximate the raised surface are an outer shoulder 25 and an inner shoulder 26 that form a transition between the raised surface and the outer rear surface and the inner rear surface. The raised surface and the shoulders 25 & 26 cooperate to form an elliptical, washer-shaped projection that extends rearward toward the inside of the club head cavity.

Figure 5B:
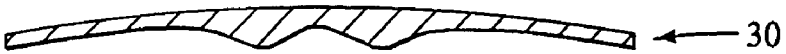
FIG. 5B is a cross-sectional view of the forged face insert of FIG. 5, taken along lines B—B in FIG. 5.
Figure 5:
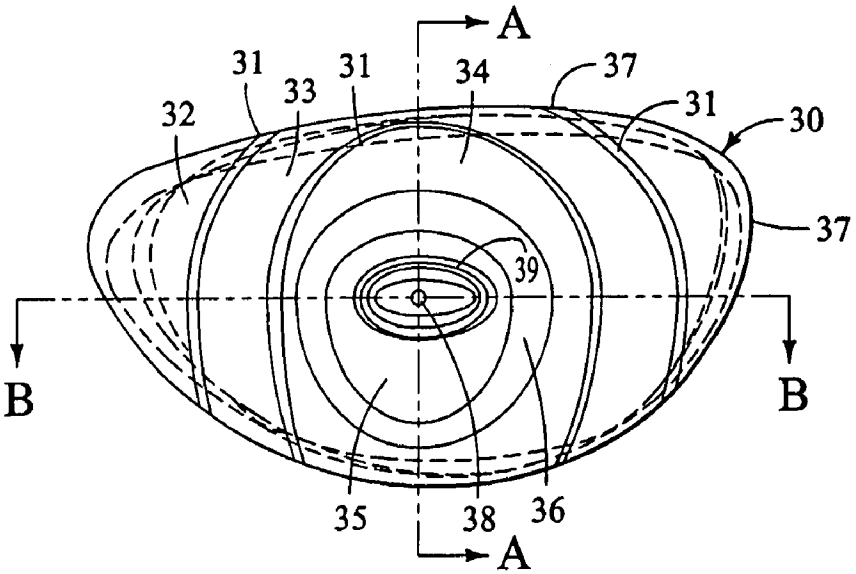
FIG. 5 is a rear elevational view of a forged face insert in a second embodiment of the present invention.
Figure 5A:
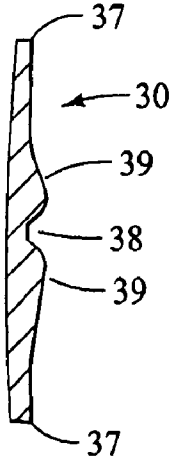
FIG. 5A is a cross-sectional view of the forged face insert of FIG. 5, taken along lines A—A in FIG. 5.

An alternative preferred striking plate 30 may be forged as a unitary structure, as shown in FIG. 5. As indicated by the topographical lines 31 showing the varying thicknesses (32, 33, 34, 35, 36), forging provides the opportunity to form relatively complex surfaces in a fairly simple process. In this example, the thickness ranges from about 1.6 mm near the periphery 37 of the plate, to about 1.9 mm radially inward from the periphery toward a balance point at about the center 38 of the striking plate. The thickness increases to about 2.5 mm further inward, up to a maximum of about 4.8 mm in a generally elliptical portion 39 surrounding a 2.5 mm thickness region at the balance point 38.

Figure 2:
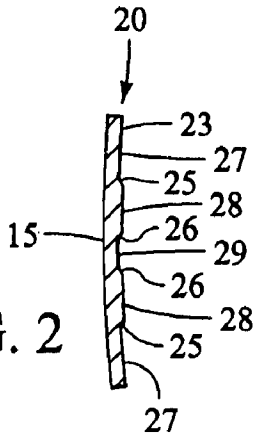
FIG. 2 is a cross-sectional view of the golf club head of FIG. 1, taken along lines 2—2 in FIG. 1.
Figure 3:
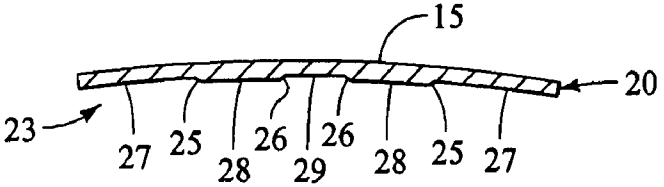
FIG. 3 is a cross-sectional view of the golf club head of FIG. 1, taken along lines 3—3 in FIG. 1.
Figure 8:
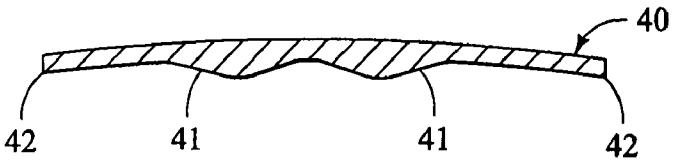
FIG. 8 is a cross-sectional view of the machined face insert of FIG. 6, taken along lines 8—8 in FIG. 6.
Figure 6:
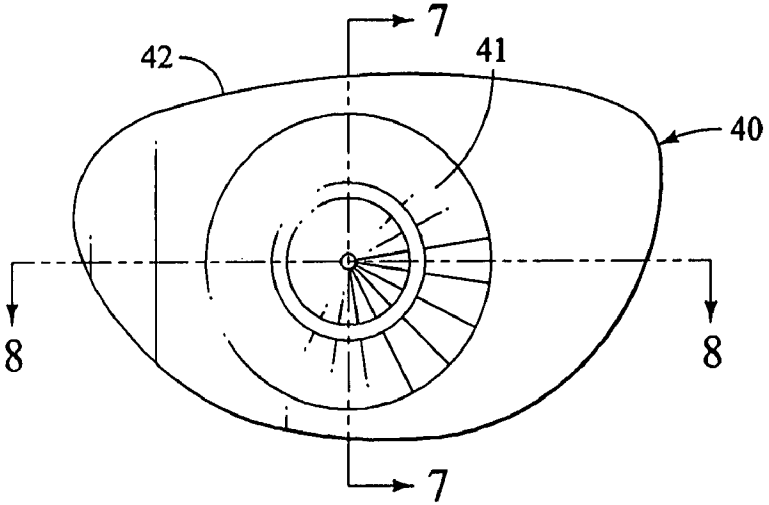
FIG. 6 is a rear elevational view of a machined face insert in another embodiment of the present invention.
Figure 7:
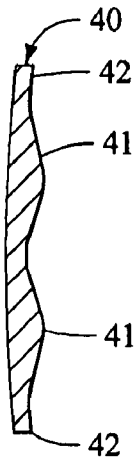
FIG. 7 is a cross-sectional view of the machined face insert of FIG. 6, taken along lines 7—7 in FIG. 6.

FIGS. 6–8 are similar to FIGS. 2–4 in that the thickness variation of the rear of the striking plate 40 of FIGS. 6–8 is more symmetrical than that shown in FIG. 5. The preferred material used in the embodiment of FIGS. 6–8 is a titanium alloy. As shown in FIG. 6 the shape of the generally annular region 41 of increased thickness is round, while in FIG. 2 the annular region of the raised surface was more elliptical. In addition, the annular region shown in FIGS. 7 and 8 is somewhat thicker and more gradual in slope than the region of maximum thickness of the raised surface shown in FIGS. 2 and 3, in which much of the raised surface is substantially flat.

The embodiments of the face portions represented in FIGS. 2–8 share a characteristic that a substantial increase in thickness occurs within about 75% of the distance from the center (e.g. 29, 38) toward the peripheral edges of the plates (e.g. 37). Preferably, the thickness increase occurs within about 50% of the distance from the center to the periphery. Also, the annular regions (e.g. 41) comprise thicknesses that are at least 50% greater than the minimum thickness found at the outermost periphery (42 in FIGS. 6–8) and cover an area at least about 12% of the total area of the striking plate 40. Preferably, the annular region 41 covers an area at least about 15%, and most preferably at least about 20%, of the total area of the striking plate. Tables I and II summarize areas of inertia welded and forged face embodiments, respectively, according to fraction of total face area for each level of thickness shown.

TABLE I

| Inertia Weld | | |
|---|---|---|
| Thickness (mm) | Area (mm^2) | Fraction of Face Area |
| 2 | 1016 | 0.31 |
| 2.5 | 843 | 0.26 |
| 3 | 666 | 0.20 |
| 3.5 | 485 | 0.15 |
| 4 | 298 | 0.09 |
| 4.5 | 113 | 0.03 |

TABLE II

| Forged Face | | |
|---|---|---|
| Thickness (mm) | Area (mm^2) | Fraction of Face Area |
| 2.1 | 1369 | 0.42 |
| 2.6 | 612 | 0.19 |
| 3.1 | 477 | 0.15 |
| 3.6 | 349 | 0.11 |
| 3.1 | 24 | 0.01 |
| 4.6 | 121 | 0.04 |

For a given material, a point on the club face can be considered beam-like in cross-section and its bending stiffness at a given location on the face can be calculated as a cubed function of its thickness, $h^3$. That is, $EI=f(h^3)$, where E is the Young's Modulus and I is the inertia. Thus, if a first point on the face has a thickness of 2 mm and a second point has a thickness of 3 mm, then the second point is 1.5 times thicker and has a stiffness that is 3.375 times that of the first point, or:

$$(3\text{ mm})^3/(2\text{ mm})^3=(1.5)^3=3.375$$

Figure 9:
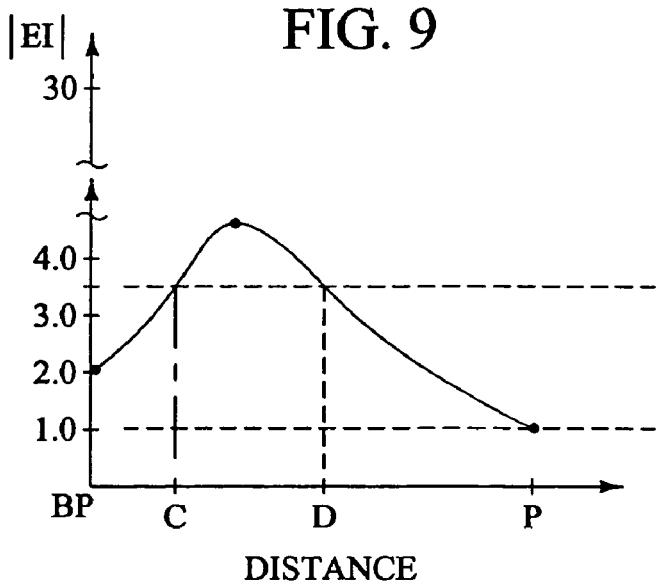
FIG. 9 is a graph showing the stiffness profile of the forged face insert of FIG. 5, from the face's balance point (BP) to a peripheral point (P).

The stiffness values in the central region of the face containing the sweet spot are at least higher than the minimum stiffness found at a peripheral point (P) at the outermost region, however the maximum stiffness of the face is provided a distance radially outward from the sweet spot. The central region does include a locally minimum stiffness value which is still greater than the lowest stiffness found at the outermost region. Referring to FIG. 9, the central region extends from BP to C, while the region including the maximum stiffness extends between C and D. The outer periphery of the face extends from D to P.

Thus, there is a stiffness profile with varying stiffness values corresponding to distances located radially outward from the sweet spot toward the periphery of the face. The striking surface of the face may be represented by quadrants defined by central axes formed from a substantially vertical plane and a substantially horizontal plane that each include the balance point of the face. At least one stiffness profile is included in each quadrant, extending generally radially from the balance point, and may or may not coincide with one of the central axes.

While a particular stiffness profile found along any radial line may or may not be repeated elsewhere on the face, each profile preferably includes at least the minimum value at the greatest radial distance from the sweet spot and the maximum value somewhere between the minimum value and the sweet spot. A generally annular region formed around the central region includes the maximum stiffness values, which generally form an ellipse or circle or the like, as well as stiffness values which are generally higher than those found in either the central region or the outermost region of the face. A preferred boundary stiffness value to differentiate this annular region is at least about 3.5 times the minimum stiffness values.

Figure 10:
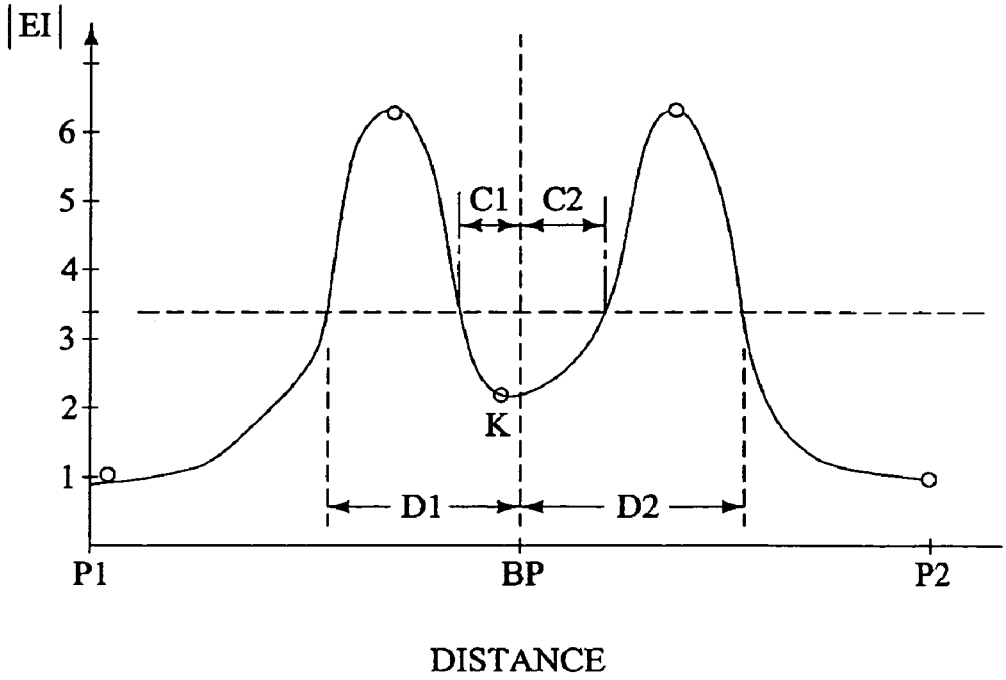
FIG. 10 is a graph showing the two stiffness profiles of the forged face insert of FIG. 5, extending from a balance point and including a local minimum of a central region that is located along the profile extending toward peripheral points P1 and P2.

The total central region comprising all of the possible stiffness profiles of the striking plate is in general reduced in stiffness from the surrounding substantially annular region. The local minimum stiffness point K found in the central region may either be at the sweet spot and thus common to any profile taken, or this point may be offset slightly and included only with a specific stiffness profile, as shown in FIG. 10. Here two stiffness profiles are shown and the length from BP to C1 is slightly less than the length from BP to C2; the lengths D1 and D2 from BP may differ, however both extend no more than about halfway to their respective peripheral points P1 and P2.

The specific stiffness profiles, taken along any of the radial lines from the sweet spot, are preferably gradual and continuous, with each region delineated by the boundary values. However, as formed using specific thicknesses, the desired stiffness profiles may be achieved using, for example, constant thickness values having abrupt changes between or within stiffness regions, such as stepped and discontinuous sections. Or, the thicknesses may include smoothly changing and continuous thicknesses, such as chamfered sections. Also, the thicknesses may include extremely variable thicknesses within a region that may be observed as rough or sharp textured surfaces or softer, undulating surfaces. Any combination of these types of thickness profiles may be employed, as long as the resultant stiffness profiles are as prescribed herein.

FIGS. 11–13 show a striking face 50 of the present invention having an alternative thickness pattern. Thickness quadrants have been formed and are divided by an X-shaped section 57 separating individual quadrants (51, 52, 53, 54) that has the same thickness as a periphery 55. This X-shaped section is centered at the balance point 56. The separate regions of increased thickness shown as quadrants (51, 52, 53, 54) are not symmetric about the balance point, as shown in FIG. 12. The quadrant toward the left 52 has a maximum thickness greater than the maximum thickness of the quadrant toward the right 54 of the balance point.

The embodiments described in detail herein are merely illustrative and the present invention may be readily embodied using alternative materials, such as composites, in lieu of metals or their alloys, as well as in hybrid constructions utilizing, for example, laminations of metal and composite materials. The club heads may be hollow or filled, have volumes greater than 300 cc or less than about 250 cc, and may comprise unitary or multi-piece bodies. In addition, the face portion may comprise an extension over one or more of the junctions with the top, bottom, toe and heel junctions with or without a hosel formation. Alternatively, it may be desirable to form a substantially unitary head without a separate striking plate, by casting or perhaps by the use of layers of composite plies. In the present invention it is the striking face region at the front of the club head having the specific bending stiffness profiles that is significant.

Advantageously, the present invention is employed to achieve COR values greater than about 0.80 across a greater portion of the striking surface as compared to conventional club heads; e.g., substantially increasing the sweet spot for a so-called "hot" metal wood golf club. However, the advantage of an increased sweet spot of the present invention is also appreciated when applied to other clubs, including utility-type club heads and irons.

Where the present invention is applied to an insert, the separate striking plate may be forged or cast, or various welding techniques may be employed to attach a separate portion behind a constant thickness portion of the striking plate. With a welding attachment of the face insert, a minimum thickness of the striking plate at the periphery should still be present immediately adjacent any weld bead formed. Alternatively, adhesive methods for attachment of the striking plate may be used as known to those skilled in the art. And, while the preferred constructions are described in detail for metal woods, i.e., drivers and fairway woods, it will be appreciated that the present invention may be utilized in irons and other clubs.

In one preferred method of manufacturing the golf club head of the present invention, a separate metallic striking plate is produced using well known forging techniques to form the desired bending stiffness profiles. Laser deposition is also contemplated, wherein a laser device is used to melt a metallic material that is then deposited onto a rear of the striking plate to obtain the desired stiffness profile. Laser devices to perform this process are known to those skilled in the art.

Figure 14A:
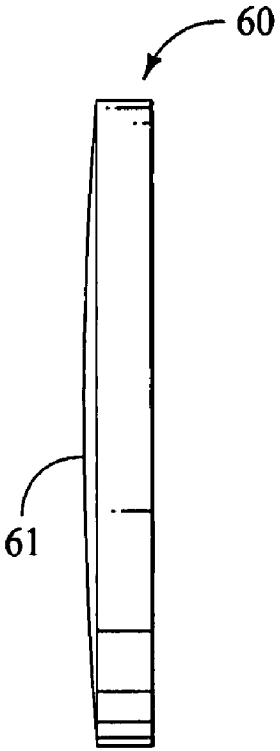
FIGS. 14 and 14A are front and side views, respectively, of a rear portion to be inertia welded to a face insert of the present invention.
Figure 14:
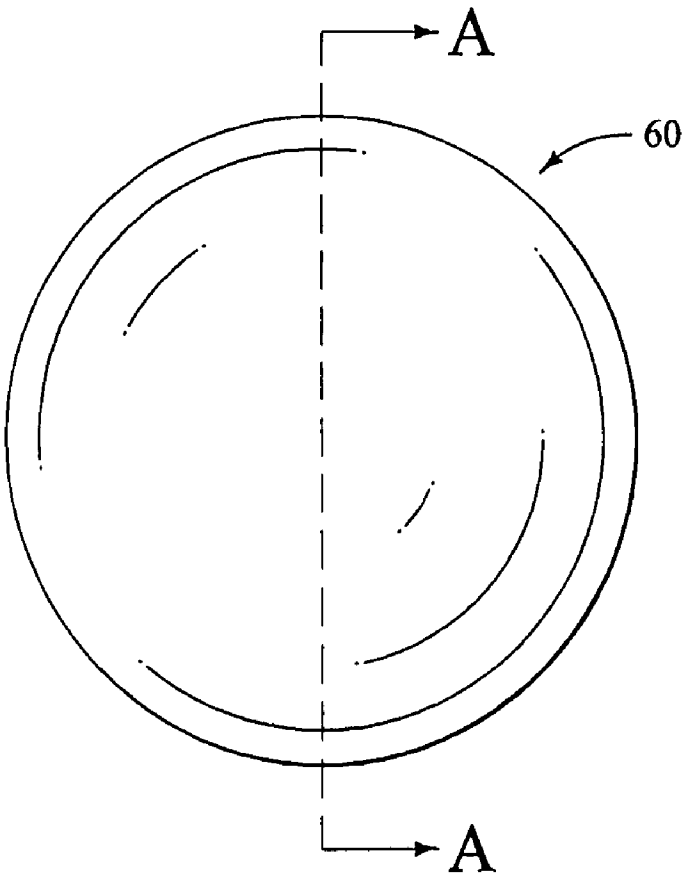
Figure 15A:
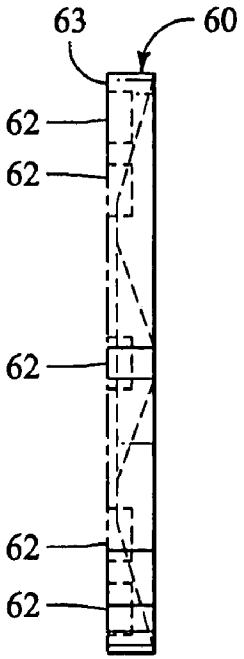
FIGS. 15 and 15A are front and side views, respectively, of the rear portion of the rear portion shown in FIGS. 14 and 14A after recesses have been formed for attachment of the inertia welding apparatus (not shown).
Figure 15:
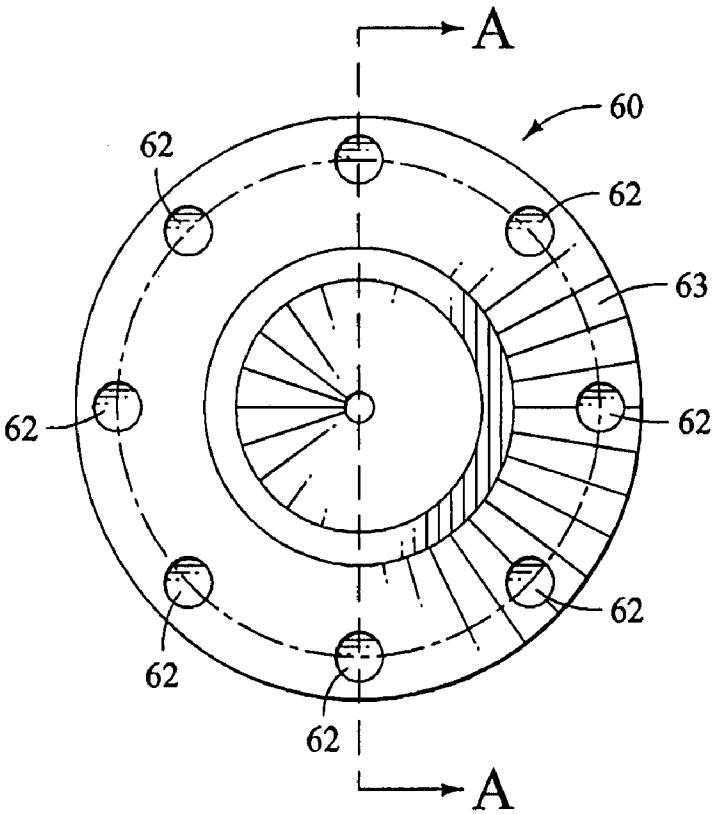
Figure 16A:
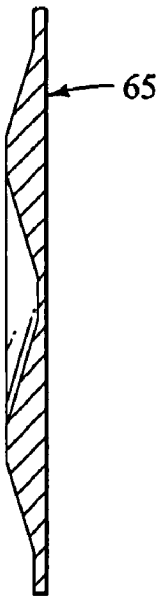
FIGS. 16 and 16A are rear elevational and cross-sectional views of the rear portion of FIG. 14, with final thicknesses.
Figure 16:
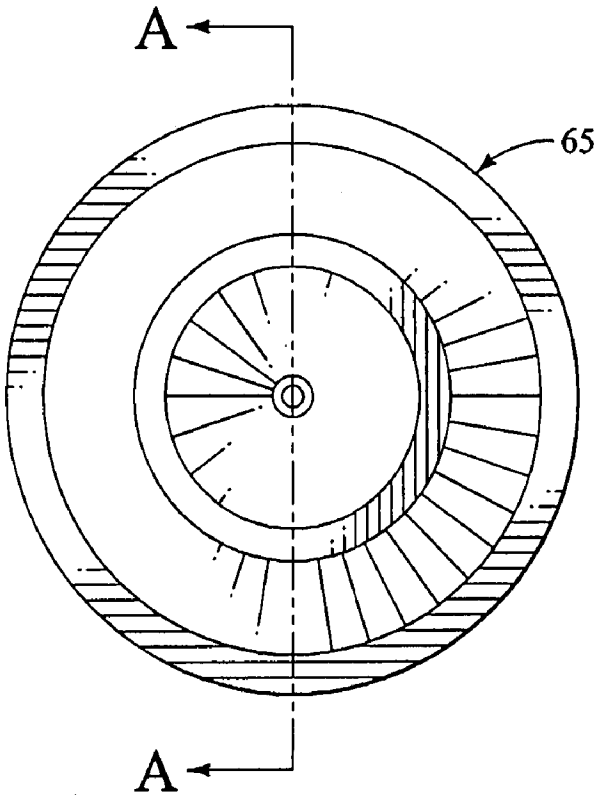

Yet another method provides the desired stiffness profile via a structure formed on the rear of a striking plate by inertia welding a separate piece to a front portion of the insert forming the striking surface. FIGS. 14–16 show the rear portion of a preferred striking plate in a sequence of configurations for attachment. Specifically, FIGS. 14 and 14A show a disk 60 approximately 38 mm in diameter and approximately 3 mm in thickness having a slightly convex surface formed on one side 61. FIGS. 15 and 15A show recesses or drive holes 62 formed around a periphery 63 of the disk, with the depths of the recesses limited by the final thickness of the surface after attachment. A device (not shown) for the inertia welding holds the disk at the recesses until welding is completed. The final shaping of the rear of the striking plate is achieved by machining, with a final preferred shape 65 shown in FIGS. 16 and 16A.

In any of the aforementioned methods, it may be desirable to machine the rear surface of the striking plate as a final step. Alternatively, a substantially constant thickness face may be machined as the process to achieve the desired stiffness profiles, instead of reserving the machining to a final step.

Composite materials may be used to form a striking plate and/or to form the remainder of the club head. For the striking plate, the desired stiffness profiles may be achieved within a relatively constant thickness by utilizing appropriately positioned materials, such as one or more types of metal fibers of varying Young's Modulus with an epoxy resin. Alternatively, a surface behind the striking surface of the face may be layered with additional plies of composite material to achieve a variable thickness profile. The additional plies may utilize the same or different fibers from those forming the striking surface.

Figure 17:
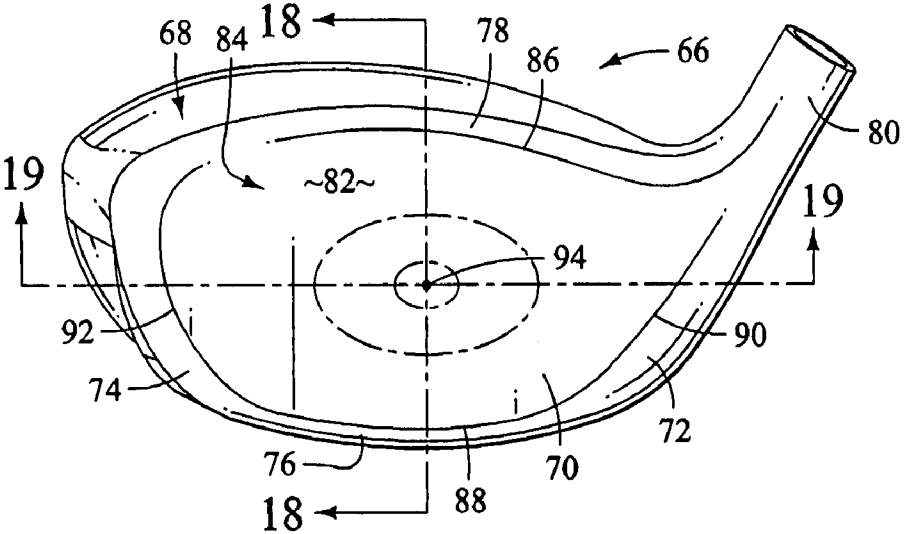
FIG. 17 is a perspective view of another alternative embodiment of a golf club head in accordance with the invention.

Another alternative embodiment of a golf club head 66 in accordance with the present invention is depicted in FIG. 17. The club head includes a hollow metallic body 68 and a striking plate 70. The body includes a heel portion 72, a toe portion 74, a sole portion 76, and a crown portion 78 that cooperate to define an opening sized to receive the striking plate. The striking plate is shown in greater detail in FIGS. 18–19. The club head is normally connected to a shaft (not shown) by a hosel 80 that is integrally formed with the body. The club head preferably is manufactured such that the body, including the heel portion, toe portion, sole portion, crown portion, and hosel are integrally formed. The striking plate, having a generally planar striking surface 82, is fixedly attached by means known in the art. However, the various portions of the preferred body may be separately molded, cast, forged, electrochemically machined, or otherwise manufactured by means known in the art, and fixedly attached to form the body.

Referring again to FIG. 17, the striking plate has the generally planar striking surface on a front side, a rear surface on a rear side, and a periphery for attachment at the opening on the body. Each point on the striking surface has a thickness and the striking surface has a total area. The striking plate has a first thickness profile between the balance point and the top edge 86, a second thickness profile between the balance point and the bottom edge 88, a third thickness profile between the balance point and the first side edge 90, and a fourth thickness profile between the balance point and the second side edge 92. The first, second, third and fourth thickness profiles each have first, second and third location with varying thickness values. The first and second thickness profiles have thickness values at the second locations that are less than the maximum values of the third and fourth thickness profiles at the second locations but greater than minimum values of the first, second, third, and fourth thickness profiles at the first locations.

Figure 18:
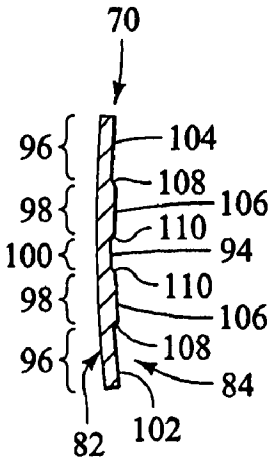
FIG. 18 is a is a detailed cross-sectional view of the striking plate, taken along lines 18—18 of FIG. 17.

FIG. 18 is a detailed cross-sectional view of striking plate, taken along lines 18—18 of FIG. 17. Referring to FIG. 18, the first, second, third, and fourth thickness profiles of striking plate all have thickness values at first locations 96 encompassing the periphery of the striking plate and including minimum values adjacent the edges. The first, second, third, and fourth thickness profiles also all have thickness values at second locations 98 positioned between the first locations and the balance point 94. The first and second thickness profiles have thickness values at the second locations that are less than the maximum values of the third and fourth thickness profiles at the second locations, but greater than minimum values of the first, second, third, and fourth thickness profiles at the first locations. The first, second, third, and fourth thickness profiles have thickness values at the third locations 100 in the central region that are less than the maximum values of the third and fourth thickness profiles at the second locations, but greater than the minimum values of the first, second, third, and fourth thickness profiles at the first locations.

The rear surface 84 of the striking plate includes an outer rear surface 102 and an inner rear surface 104. A generally ring-shaped raised surface 106 is formed between the outer surface and the inner surface. Proximate the raised surfaces are an outer shoulder 108 and an inner shoulder 110 that form transitions between the raised surface and the respective outer surface and inner surface. The raised surfaces and the outer and inner shoulders cooperate to form a generally ring-shaped projection extending rearward toward the inside of the club head cavity.

Figure 19:
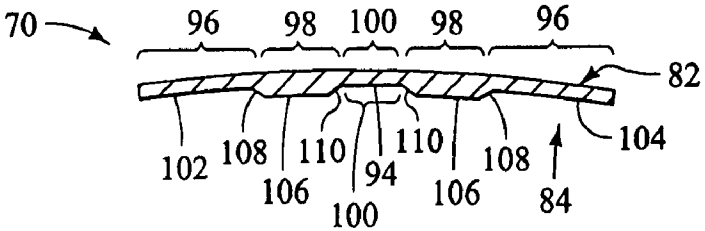
FIG. 19. is a detailed cross-sectional view of the striking plate, taken along lines 19—19 of FIG. 17, showing the third and fourth thickness profiles at the second locations with maximum values.

FIG. 19 is a detailed cross-sectional view of the striking plate taken along lines 19—19 of FIG. 17. Referring to FIG. 19, the third and fourth thickness profiles have thickness values that are at least 1.5 times the minimum values and include points with the maximum values at the second locations. The first, second, third, and fourth thickness profiles have thickness values at the third locations in the central region that are less than the maximum values of the third and fourth thickness profiles at the second locations, but greater than the minimum values of the first, second, third, and fourth thickness profiles at the first locations. The rear surface of the striking plate includes an outer rear surface and an inner rear surface with a generally ring-shaped raised surface defined between them. An outer shoulder and an inner shoulder form transitions between the raised surfaces and the respective outer surface and inner surface. The raised surface and the shoulders cooperate to form a generally ring-shaped projection extending rearward toward the inside of the club head cavity. The maximum thickness values of the generally ring-shaped projection occur at the second locations of the third and fourth thickness profiles. This embodiment differs from earlier described embodiments in that the maximum thickness values of the annular projection occur only at the toe and heel portions of the striking face and not at the sole and crown portions of the striking face. This alternative embodiment provides the additional benefit of having a high COR, while still providing significant forgiveness for off center hits without the additional weight of having maximum thickness values at the crown and sole portions of the annular projection.

Another alternative embodiment of a golf club head in accordance with the present invention includes a club head with a hollow metallic body and a striking plate. The body includes a heel portion, a toe portion, a sole portion, and a crown portion that cooperate to define an opening sized to receive the striking plate. The club head preferably is manufactured such that the body, including the heel portion, toe portion, sole portion, crown portion, and hosel are integrally formed. The striking plate, having a generally planar striking surface, is fixedly attached by means known in the art. However, the various portions of the preferred body may be separately molded, cast, forged, electrochemically machined, or otherwise manufactured by means known in the art, and fixedly attached to form the body.

The striking plate has the generally planar striking surface on a front side, a rear surface on a rear side, and a periphery for attachment at the opening on the body. Each point on the striking surface has a stiffness profile and the striking surface has a total area. The striking plate has a first stiffness profile between the balance point and the top edge, a second stiffness profile between the balance point and the bottom edge, a third stiffness profile between the balance point and the first side edge, and a fourth stiffness profile between the balance point and the second side edge. The first, second, third, and fourth stiffness profiles of striking plate all have stiffness values at first locations encompassing the periphery of the striking plate and including minimum values adjacent the periphery. The first and second stiffness profiles have stiffness values at the second locations that are less than the maximum values of the third and fourth stiffness profiles at the second locations, but greater than minimum values of the first, second, third, and fourth stiffness profiles at the first locations. The first, second, third, and fourth stiffness profiles have stiffness values at the third locations in the central region that are less than the maximum values of the third and fourth stiffness profiles at the second locations, but greater than the minimum values of the first, second, third, and fourth stiffness profiles at the first locations.

The third and fourth stiffness profiles have stiffness values that are at least 3.5 times the minimum stiffness values and include points with the maximum values at the second locations. The first, second, third, and fourth stiffness profiles have stiffness values at the third locations in the central region that are less than the maximum values of the third and fourth stiffness profiles at the second locations, but greater than the minimum stiffness values of the first, second, third, and fourth stiffness profiles at the first locations. The maximum stiffness values of the striking plate occur at the second locations of the third and fourth stiffness profiles.

It should be evident from the drawings and the discussion above that the golf club head of the present invention exhibits greater forgiveness across a substantial portion of the striking surface while continuing to impart high initial velocity to a golf ball.

Although the invention has been described in detail with reference to the presently preferred embodiments, those of ordinary skill in the art will appreciate that various modifications can be made without departing from the invention. Accordingly, the invention is defined only by the following claims.

We claim:

1. A golf club head comprising:

a body having a toe portion, a heel portion, a sole portion, and a crown portion, together defining an opening;

a striking plate disposed at the opening, the striking plate having a striking surface, a rear surface opposed to the striking surface and defining a thickness therebetween, and a periphery;

wherein the periphery has a first edge, a second edge, a third edge, and a fourth edge;

a balance point disposed in a central region of the striking surface, a first thickness profile extending between the balance point and the first edge, a second thickness profile extending between the balance point and the second edge, a third thickness profile extending between the balance point and the third edge, and a fourth thickness profile extending between the balance point and the fourth edge;

wherein each of the first, second, third, and fourth thickness profiles includes a first region encompassing the periphery of the striking plate, a second region disposed between the first region and the balance point, and a third region disposed between the second region and the balance point;

wherein each of the third and fourth thickness profiles has a maximum second region thickness at least 1.5 times greater than a minimum first region thickness;

wherein each of the first and second thickness profiles has a second region thickness that is less than the maximum second region thickness of the third and fourth thickness profiles and greater than or equal to the minimum first region thickness; and wherein each of the first, second, third, and fourth thickness profiles has a third region thickness that is less than the maximum second region thickness of the third and fourth thickness profiles and greater than the minimum first region thickness.

2. The golf club head of claim 1, wherein the first edge is a top edge of the striking plate, the second edge is a bottom edge of the striking plate, the third edge is a heel side edge of the striking plate, and the fourth edge is a toe side edge of the striking plate.

3. The golf club head of claim 1, wherein the second region comprises a substantially annular region of increased thickness.

4. The golf club head of claim 1, wherein the golf club head is a wood-type golf club head with a coefficient of restitution greater than 0.80.

5. A striking plate for a golf club head, comprising:

a striking surface, a rear surface opposed to the striking surface and defining a thickness therebetween, and a periphery, wherein the periphery has a first edge, a second edge, a third edge and a fourth edge;

a balance point disposed in a central region of the striking surface, a first thickness profile extending between the balance point and the first edge, a second thickness profile extending between the balance point and the second edge, a third thickness profile extending between the balance point and the third edge, and a fourth thickness profile extending between the balance point and the fourth edge;

wherein each of the first, second, third, and fourth thickness profiles includes a first region encompassing the periphery of the striking plate, a second region disposed between the first region and the balance point, and a third region disposed between the second region and the balance point;

wherein each of the third and fourth thickness profiles has a maximum second region thickness at least 1.5 times greater than a minimum first region thickness;

wherein each of the first and second thickness profiles has a second region thickness that is less than the maximum second region thickness of the third and fourth thickness profiles and greater than or equal to the minimum first region thickness; and wherein each of the first, second, third, and fourth thickness profiles has a third region thickness that is less than the maximum second region thickness of the third and fourth thickness profiles and greater than the minimum first region thickness.

6. The golf club head of claim 5, wherein the second region comprises a substantially annular region of increased thickness.

7. A golf club head comprising:

a body having a toe portion, a heel portion, a sole portion, a crown portion and a striking plate, wherein the striking plate has a striking surface, a rear surface opposed to the striking surface and defining a thickness therebetween, and a periphery, wherein the periphery has a first edge, a second edge, a third edge, and a fourth edge;

a balance point disposed in a central region of the striking surface, a first thickness profile extending between the balance point and the first edge, a second thickness profile extending between the balance point and the second edge, a third thickness profile extending between the balance point and the third edge, and a fourth thickness profile extending between the balance point and the fourth edge;

wherein each of the first, second, third, and fourth thickness profiles includes a first region encompassing the periphery of the striking plate, a second region disposed between the first region and the balance point, and a third region disposed between the second region and the balance point; and wherein each of the first, second, third, and fourth thickness profiles has a third region thickness that is greater than a first region thickness and less than a second region thickness.

8. The golf club head of claim 7, wherein the first edge is a top edge of the striking plate, the second edge is a bottom edge of the striking plate, the third edge is a heel side edge of the striking plate, and the fourth edge is a toe side edge of the striking plate.

9. The golf club head of claim 7, wherein the golf club head is a wood-type golf club head with a coefficient of restitution greater than 0.80.

10. The golf club head of claim 7, wherein each of the third and fourth thickness profiles has a maximum second region thickness that is greater than the maximum second region thickness of the first and second thickness profiles.

11. The golf club head of claim 7, wherein each of the third and fourth thickness profiles has a maximum second region thickness that is greater than the maximum second region thickness of the first thickness profile.

12. The golf club head of claim 7, wherein each of the third and fourth thickness profiles has a maximum second region thickness that is greater than the maximum second region thickness of the second thickness profile.

13. The golf club head of claim 7, wherein the second region comprises a substantially annular region of increased thickness.

14. A striking plate for a golf club head, comprising:

a striking surface, a rear surface opposed to the striking surface and defining a thickness therebetween, and a periphery, wherein the periphery has a first edge, a second edge, a third edge and a fourth edge;

a balance point disposed in a central region of the striking surface, a first thickness profile extending between the balance point and the first edge, a second thickness profile extending between the balance point and the second edge, a third thickness profile extending between the balance point and the third edge, and a fourth thickness profile extending between the balance point and the fourth edge;

wherein each of the first, second, third, and fourth thickness profiles includes a first region encompassing the periphery of the striking plate, a second region disposed between the first region and the balance point, and a third region disposed between the second region and the balance point; and wherein each of the first, second, third, and fourth thickness profiles has a third region thickness that is greater than a first region thickness and less than a second region thickness.

15. The striking plate of claim 14, wherein each of the third and fourth thickness profiles has a maximum second region thickness that is greater than the maximum second region thickness of the first and second thickness profiles.

16. The striking plate of claim 14, wherein each of the third and fourth thickness profiles has a maximum second region thickness that is greater than the maximum second region thickness of the first thickness profile.

17. The striking plate of claim 14, wherein each of the third and fourth thickness profiles has a maximum second region thickness that is greater than the maximum second region thickness of the second thickness profile.

18. The striking plate of claim 14, wherein the second region comprises a substantially annular region of increased thickness.

19. A striking plate for a golf club head, comprising:

a striking surface, a rear surface opposed to the striking surface and defining a thickness therebetween, and a periphery, wherein the periphery has a first edge, a second edge, a third edge and a fourth edge;

a balance point disposed in a central region of the striking plate, a first stiffness profile extending between the balance point and the first edge, a second stiffness profile extending between the balance point and the second edge, a third stiffness profile extending between the balance point and the third edge and a fourth stiffness profile between the balance point and the fourth edge;

wherein each of the first, second, third, and fourth stiffness profiles includes a first region encompassing the periphery of the striking plate, a second region disposed between the first region and the balance point, and a third region disposed between the second region and the balance point;

wherein each of the third and fourth stiffness profiles has a maximum second region stiffness at least 3.5 times greater than a minimum first region stiffness;

wherein each of the first and second stiffness profiles has a second region stiffness that is less than the maximum second region stiffness of the third and fourth stiffness profiles and greater than or equal to the minimum first region stiffness; and wherein each of the first, second, third, and fourth stiffness profiles has a third region stiffness that is less than the maximum second region stiffness of the third and fourth stiffness profiles and greater than the minimum first region stiffness.

20. The striking plate of claim 19, wherein the second region comprises a substantially annular region of increased stiffness.

* * * * *